United States Patent [19]

Walser et al.

[11] 4,423,294

[45] Dec. 27, 1983

[54] LAMINATE SWITCH ASSEMBLY HAVING IMPROVED DURABILITY

[75] Inventors: Richard J. Walser; Gary M. Wyant, both of Urbana, Ohio

[73] Assignee: The Hall Company, Urbana, Ohio

[21] Appl. No.: 389,527

[22] Filed: Jun. 17, 1982

[51] Int. Cl.[3] ..... H01H 3/12

[52] U.S. Cl. ..... 200/5 A; 200/159 B; 200/292

[58] Field of Search ..... 200/5 A, 159 B, 292

[56] References Cited

U.S. PATENT DOCUMENTS

| | | | |
|---|---|---|---|
| 3,643,041 | 2/1972 | Jackson | 200/5 A |
| 3,860,771 | 1/1975 | Lynn et al. | 200/5 A |
| 3,952,174 | 4/1976 | Boulanger et al. | 200/5 A |
| 3,987,259 | 10/1976 | Larson | 200/5 A |
| 3,988,551 | 10/1976 | Larson | 200/5 A |
| 3,995,126 | 11/1976 | Larson | 200/5 A |
| 4,005,293 | 1/1977 | Boulanger | 200/5 A |
| 4,033,030 | 7/1977 | Robinson et al. | 29/622 |
| 4,046,975 | 9/1977 | Seeger, Jr. | 200/5 A |
| 4,060,703 | 11/1977 | Everett, Jr. | 200/5 A |
| 4,068,369 | 1/1978 | Kaminski | 29/622 |
| 4,158,115 | 6/1979 | Parkinson et al. | 200/159 B |
| 4,197,439 | 4/1980 | Mecklenburg et al. | 200/159 B |
| 4,254,309 | 3/1981 | Johnson | 200/5 A |
| 4,284,866 | 8/1981 | Bryce et al. | 200/159 B |
| 4,289,943 | 9/1981 | Sado | 200/159 B |
| 4,314,117 | 2/1982 | Ditzig | 200/5 A |
| 4,376,238 | 3/1983 | Martin | 200/5 A |

OTHER PUBLICATIONS

Page of an advertisement by Cherry Electrical Products Corp., entitled "One-Of-A-Kind" Cherry Custom Membrane Keyboards.

*Primary Examiner*—E. A. Goldberg
*Assistant Examiner*—Morris Ginsburg
*Attorney, Agent, or Firm*—Biebel, French & Nauman

[57] ABSTRACT

A laminate switch assembly or keyboard comprises a tensioned dome switch plate having improved durability which provides tactile feedback to the operator. Each tensioned dome on the switch plate is aligned with an electrical contact area formed on a printed circuit board so that depression of the dome completes an electrical circuit through the aligned contact area. Each tensioned dome is surrounded by a reinforcing collar or band which relieves the stresses normally produced in the transition area between the switch domes and the remaining planar portion of the switch plate.

10 Claims, 2 Drawing Figures

LAMINATE SWITCH ASSEMBLY HAVING IMPROVED DURABILITY

BACKGROUND OF THE INVENTION

This invention relates generally to laminate switch assemblies wherein tensioned diaphragms provide a tactile indication of switch activation and, more particularly, to an improved switch activating diaphragm structure which includes a surrounding reinforcing collar to relieve the stresses created in the area between such diaphragms and adjacent planar portions of a diaphragm plate.

A large variety of printed circuit contact switches are available for use as information input keyboards. Such keyboards are used for an ever expanding number of products ranging from calculators to microwave ovens. Of the available switch varieties, many do not provide tactile feedback and, hence, may be unacceptable for some users.

An inexpensive way to form keyboards having tactile feedback is to deposit electrical contact patterns onto a printed circuit board and to provide a tensioned diaphragm or dome over each of the contact patterns. Electrically conducting pads which match the contact patterns on the circuit board are provided so that when a dome is depressed by an operator's finger, an associated pad contacts one of the deposited contact patterns to complete an electrical circuit through the contact pattern. Upon removal of the operating force, the tensioned dome springs back to its initial unoperated position to open the circuit through the contact pattern. The electrically conducting pads can be provided on the interior surface of the dome or can be provided on a separate contact sheet formed from insulating material.

Such switch assemblies form reliable electrical connections and provide tactile feedback to an operator to reassure the operator that the switch contact has been closed. Although keyboards formed from such switches are highly reliable, there tend to be problems in that the domes or diaphragms are formed into sheets of plastic material and, hence, are subject to deterioration with use.

SUMMARY OF THE INVENTION

In accordance with the present invention, a laminate switch assembly is economically constructed to include a tensioned dome switch plate which has improved durability. Each tensioned dome on the switch plate is aligned with a switch contact area formed on a printed circuit board so that depression of the dome completes an electrical circuit through the contact area. Each dome, however, is surrounded by a reinforcing collar or band which relieves the stresses which normally are produced in the transition area between the tensioned domes and the remaining planar portion of the switch plate. This is the area of prior art switch plates which tend to fatigue and deteriorate with use.

The tensioned dome switch plate is formed from commercially available thermoplastic material such as that offered under the trademark Lexan registered to the General Electric Company. The tensioned domes and reinforcing collars or bands can be formed into the thermoplastic at the same time. The tensioned domes and the reinforcing collars are of approximately the same cross-sectional thickness with the domes extending above the reinforcing collars and the collars being arched upwardly to form an externally appearing ridge around each dome.

Key designations can be formed directly into the tensioned domes and the reinforcing collars or bands can be composed of contrasting colors to provide a pleasing appearance to keyboards using the switch plates in accordance with the present invention. During the switch operating deformations of the tensioned domes, the reinforcing collars experience certain limited flexure in performing their function of stress relief. However, compared to the movement of the switch domes, the reinforcing collars remain substantially stationary throughout switching operations.

Laminate switch assemblies incorporating the improved durability switch plate in accordance with the present invention can comprise separate electrical switching contact pads which are spaced from the printed circuit board, or electrically conductive coatings can be formed or deposited on the interior surfaces of the tensioned domes.

It is, therefore, an object of the present invention to provide a laminate switch assembly having improved durability while maintaining inexpensive manufacture techniques; and to provide a laminate switch assembly having an improved tactile dome switch plate wherein each tensioned dome is surrounded by a reinforcing collar or band whereby stresses are relieved in the transition area between the switch domes and the remaining planar portions of the switch plate.

Other objects and advantages of the present invention will be apparent from the following description, the accompanying drawings and the appended claims.

DETAILED DESCRIPTION OF THE INVENTION

Figure 1:
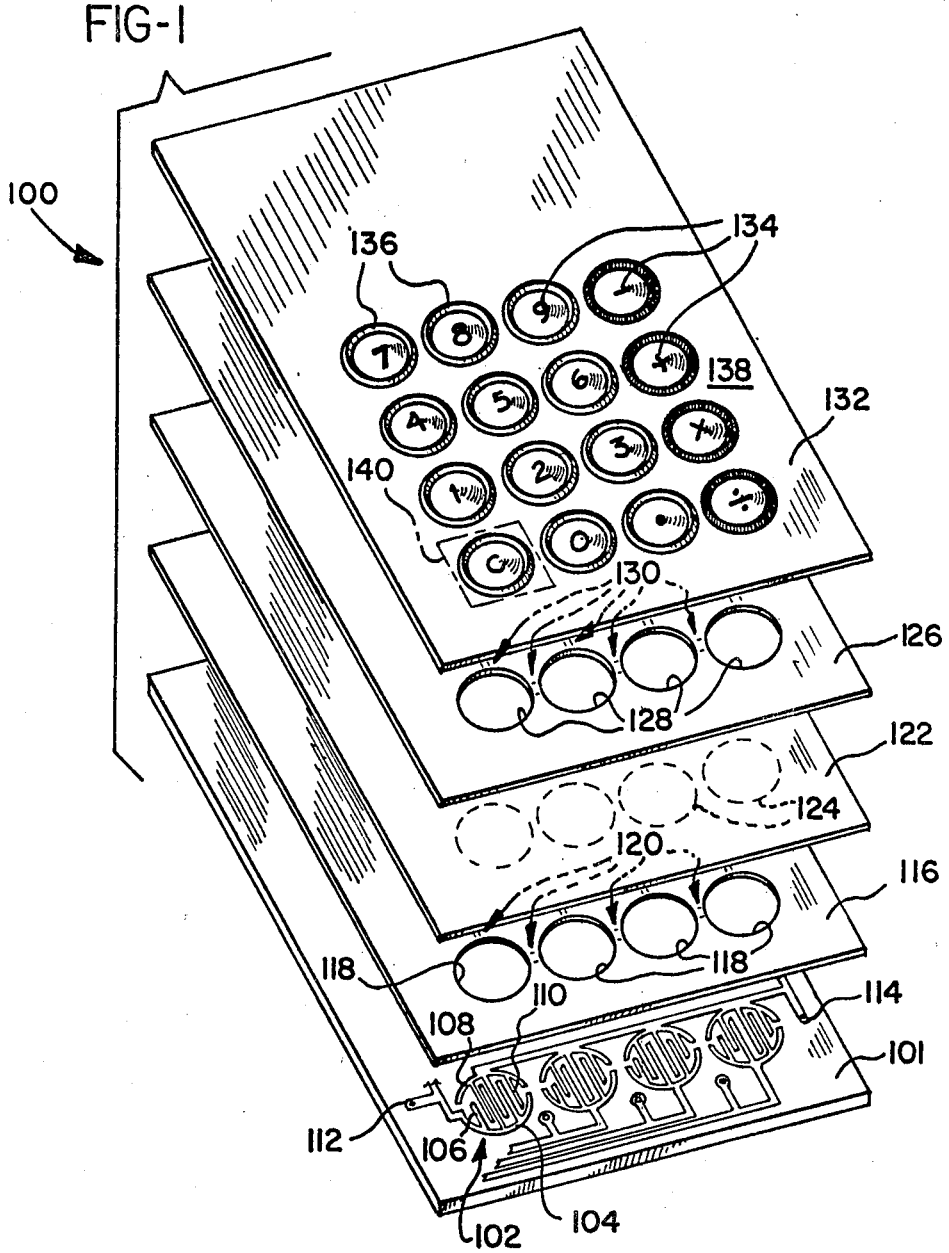
FIG. 1 is an exploded view of one embodiment of a laminate switch assembly in accordance with the present invention.

With reference to FIG. 1, a five-layered laminate switch assembly or keyboard 100 constructed in accordance with the present invention is shown in exploded view. The first layer comprises a circuit board 101 upon which electrical conducting paths are deposited. A contact pattern 102 comprising an intermeshed pair of electrical contact areas is deposited for each switch or key of the keyboard. The contact patterns 102 as disclosed comprise generally circular areas.

Each contact pattern 102 comprises a pair of electrical contact areas. The first contact area of each pattern comprises a downwardly arched conductor 104 which has extending upwardly therefrom fingers 106; and the second contact area of each pattern comprises an upwardly arched conductor 108 which has fingers 110 extending downwardly. The upwardly extending fingers 106 are intermeshed with the downwardly extending fingers 110 to facilitate electrical conduction between the conductors 104 and 108 by shorting the adjacent intermeshed fingers to one another.

A connection can be made to the conductor 104 through a terminal 112 and to the conductor 108 through the terminal 114. It can be seen that this configuration of the electrical contact pattern 102 facilitates the operation of an associated switch since the intermeshed fingers 106, 110 can be conveniently shorted to one another to close the electrical path between electrical terminals such as the terminals 112 and 114. However, it is noted that a large variety of contact patterns can be used in the present invention.

The second layer of the laminate switch assembly or keyboard 100 comprises an electrically insulating spacer 116 which has circular openings 118 aligned with the contact patterns 102 formed on the circuit board 101. The circular apertures 118 may be interconnected by channels 120 to permit air to pass between the individual switches of the laminate keyboard 100. Such movement of air between the switches of the laminate keyboard 100 facilitates operation in the event that the keyboard is sealed and deflection of the tensioned domes would otherwise be resisted by the trapped air within the domes.

The third layer of the laminate keyboard 100 is constructed from a sheet 122 of electrically insulating material, such as Mylar, and includes electrically conducting pads 124 on the underside of the sheet 122. The electrically conducting pads 124 are aligned with the holes 118 in the insulator 116 and the contact patterns 102. The conducting pads 124 are circular in the illustrative embodiment and can be performed and adhered to the undersurface of the sheet 122 or can be formed or deposited onto the underside of the sheet 122.

The fourth layer of the laminate keyboard 100 comprises a second electrically insulating spacer 126 comparable to the sheet 116. The spacer 126 again is constructed from an insulating material and includes circular openings 128 centered upon the contact patterns 102. Here, again, the circular openings 128 may be interconnected by channels 130 for air movement within the laminate keyboard as previously described.

The fifth layer of the laminate keyboard 100 comprises the tensioned dome switch plate 132 which is preferably formed from commercially available thermoplastic material such as that offered under the trademark Lexan registered to the General Electric Company. A plurality of tensioned domes 134 are formed into the surface of the thermoplastic material which forms the tensioned dome switch plate 132. In accordance with the present invention, each of the tensioned domes 134 is surrounded by a stress relief collar or band 136 to improve the durability and life expectancy of the switch plate 132 and, hence, the laminate keyboard 100 incorporating the tensioned dome switch plate 132.

Figure 2:
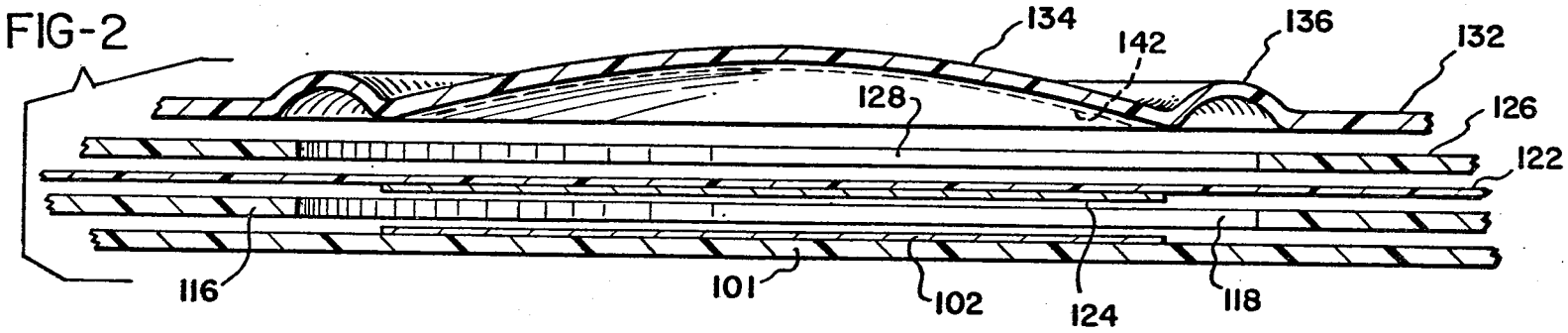
FIG. 2 is a cross-section of one switching element of the embodiment of FIG. 1.

The tensioned domes 134 extend above the collars 136. The collars 136 serve to buffer and relieve the stresses which are otherwise created in that portion of the switch plate 132 which extends between the edge of the tensioned domes 134 and the planar surface 138 of the switch plate 132. The structure of the individual layers of the laminate keyboard of the illustrative embodiment of the invention of FIG. 1 is shown in more detail in a cross-sectional view through one of the switches of the laminate keyboard 100 in FIG. 2.

The stress relief collar or band 136 shown in FIG. 1 is concentric with the outer edge of the tensioned dome 134 which it surrounds. Of course, in accordance with the present invention, the collar 136 can be square as shown by the dotted line figure 140 or can take other geometric forms surrounding the tensioned domes 134. Advantageously, by surrounding each of the tensioned domes 134 with a collar 136, the durability of the dome switch plate 132 is increased. The collars 136 tend to buffer and relieve the strain which is normally produced by flexure of the tensioned domes 134 upon operation of the associated switches so that the areas which interconnect the tensioned domes 134 to the planar areas 138 of the dome switch plate 132 have a longer life expectancy.

While disclosed in a five layer laminate switch or keyboard assembly, the present invention may be included in a variety of embodiments. One or both of the spacers 116 and 126 can be eliminated and the conductive pads 124 can be incorporated into the inner surfaces of the tensioned domes 134 by deposition or formation of conductive material 142 on the inner surfaces of the domes. These as well as other modifications and alternate embodiments will be apparent to those skilled in the art from the above description.

While the forms of apparatus herein described constitute preferred embodiments of this invention, it is to be understood that the invention is not limited to these precise forms of apparatus and that changes may be made therein without departing from the scope of the invention which is defined in the appended claims.

What is claimed is:

1. A laminate switch assembly comprising:

a printed circuit board having at least one pair of electrical contact areas formed thereon;

a tactile dome switch plate having a tensioned tactile dome aligned with each pair of said at least one pair of electrical contact areas on said circuit board and a reinforcing band encircling each tactile dome; and contact means interposed between said circuit board and said switch plate for interconnecting an aligned pair of contact areas upon depression of an associated tensioned tactile dome whereby an electrical connection is completed through said aligned pair of contact areas by depressing said associated tensioned tactile dome and stresses created in said switch plate between said associated tensioned tactile dome and the remainder of said switch plate due to the flexure of said associated tensioned tactile dome are relieved by said reinforcing band which remains substantially stationary compared to the movement of said tactile dome upon depression and release of said associated tensioned tactile dome.

2. The laminate switch assembly of claim 1 wherein said contact means comprises an electrically conductive coating on the interior surface of said associated tenionsed tactile dome.

3. The laminate switch assembly of claim 1 wherein said tensioned tactile dome and said reinforcing band are approximately equal in thickness and are formed into said switch plate.

4. The laminate switch assembly of claim 3 wherein said switch plate is formed of a thermoplastic material.

5. The laminate switch assembly of claim 4 wherein a key designation is formed into said tensioned tactile dome and said reinforcing band is formed of a contrasting color whereby a permanent key designation and a pleasing appearance can be imparted to said laminate switch assembly.

6. A laminate switch assembly comprising:

a printed circuit board having a plurality of intermeshed pairs of electrical contact areas formed thereon;

a first electrically insulating spacer covering said circuit board and including apertures therethrough aligned with each of said pairs of electrical contact areas;

an electrically insulating contact sheet having electrically conducting pads corresponding in number to said pairs of electrical contact areas and positioned on the underside of said sheet in alignment with said apertures so that said pads are positioned opposite to but spaced apart from said electrical contact areas by said first spacer;

a second electrically insulating spacer covering said contact sheet and including apertures therethrough aligned with each pair of said electrical contact areas; and a tactile dome switch plate covering said second electrically insulating spacer and having tensioned switch domes formed into an otherwise substantially planar plate, said tensioned switch domes being aligned with said pairs of electrical contact areas and having reinforcing collars completely surrounding them, said reinforcing collars remaining substantially stationary during flexing movement of said tensioned switch domes to operate said laminate switch assembly whereby stresses in the transition area between said tensioned switch domes and the planar portion of said switch plate are relieved.

7. The laminate switch assembly of claim 6 wherein said reinforcing collars comprise raised circular rings concentric with said switch domes.

8. The laminate switch assembly of claim 6 or 7 wherein said switch domes extend above said reinforcing collars.

9. The laminate switch assembly of claim 8 wherein said tactile dome switch plate including said switch domes and said reinforcing collars are formed of approximately equal thickness thermoplastic.

10. The laminate switch assembly of claim 9 wherein said reinforcing collars are upwardly arched.

* * * * *